United States Patent [19]

Martinet et al.

[11] Patent Number: 4,640,311

[45] Date of Patent: Feb. 3, 1987

[54] MODULAR SYSTEM OF DISTRIBUTION

[75] Inventors: Roland Martinet, Blois; Alain Casas, Vineuil, both of France

[73] Assignee: Climax France S.A., France

[21] Appl. No.: 754,465

[22] Filed: Jul. 12, 1985

Related U.S. Application Data

[63] Continuation of Ser. No. 407,053, Aug. 11, 1982, abandoned.

[30] Foreign Application Priority Data

Aug. 14, 1981 [FR] France ..... 81 15778

[51] Int. Cl.[4] ..... F15B 13/07

[52] U.S. Cl. ..... 137/884; 137/271; 137/596.14; 137/596.18

[58] Field of Search ..... 137/119, 271, 596.1, 137/596.14, 596.18, 624.14, 884

[56] References Cited

U.S. PATENT DOCUMENTS

| | | | |
|---|---|---|---|
| 3,513,876 | 5/1970 | Tarbox | 137/884 X |
| 3,680,589 | 8/1972 | Jeans et al. | 137/271 X |
| 4,402,254 | 9/1983 | Petrimaux et al. | 137/110 X |
| 4,415,004 | 11/1983 | Bouteille et al. | 137/884 |

*Primary Examiner*—A. Michael Chambers
*Assistant Examiner*—John C. Fox
*Attorney, Agent, or Firm*—Steinberg & Raskin

[57] ABSTRACT

The invention relates to a system of distribution of a fluid under pressure for a driving device. The system comprises a main distributor $D_3$ mounted on a base plate $E_3$, and at least one auxiliary unit such as a progressive starter $U_1$ or a drain-blocker $U_2$, wherein the auxiliary unit $U_1$, $U_2$ comprises a standard distributor $D_1$, $D_2$, advantageously of the same type as the main distributor $D_3$, which is mounted interchangeably on a specific base plate $E_1$, $E_2$ configured to determine the function of the auxiliary unit and associable with the base plate $E_3$ of the main distributor $D_3$ and with the base plates of other auxiliary units if any.

11 Claims, 6 Drawing Figures

MODULAR SYSTEM OF DISTRIBUTION

This is a continuation of application Ser. No. 407,053, filed 8-11-82, now abandoned.

The present invention has for a subject matter a modular system of distribution of a fluid under pressure for the control of a driving device such as a pneumatic motor or actuating cylinder, or a valve, comprising at least one main distributor mounted interchangeably on a base plate designed to ensure the connection of the distributor with the driving device and with the system of supply of fluid under pressure, and at least one auxiliary unit mounted upstream of the distributor, such as a unit fulfilling the function of a progressive starter or of a drain-blocker.

In the known systems of distribution of this type, the drain-blocker and the progressive starter are non-standardized type four way-two position 4/2 apparatuses specifically designed to accomplish the functions of a drain-blocker and a progressive starter, respectively. Such apparatuses cannot be used to perform other functions.

It is obvious that the use in a system of a great number of specific elements is a considerable drawback, for it makes the system complex and therefore expensive and of poor flexibility inasmuch as the essential elements are not interchangeable and that a certain number of elements of each type must always be kept in reserve to ensure rapid replacement of a defective element with an element in good operating condition.

The purpose of the present invention is to remedy this drawback.

To attain this purpose, the modular system of distribution according to the invention is characterized in that the auxiliary unit comprises a standard distributor, advantageously of the same type as the distributor proper, which is mounted interchangeably on a specific base plate so configured as to determine the function of the unit and associable with the base plate of the distributor proper and with base plates of other auxiliary units if any.

The invention will be better understood and other purposes, characterizing features, details and advantages of the latter will appear more clearly from the following explanatory description made with reference to the appended diagrammatic drawings given solely by way of example illustrating one form of embodiment of the invention and wherein.

Figure 1:
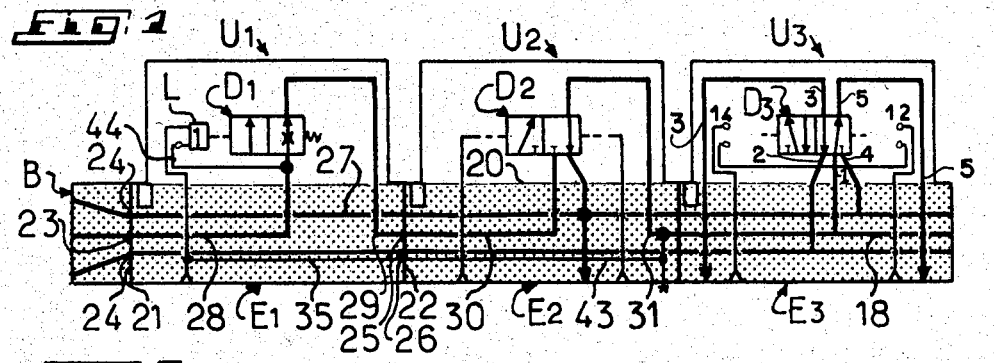
FIG. 1 is a diagrammatic view of a modular system of distribution according to the present invention, comprising, mounted upstream of a distributor unit, an assembly of two auxiliary units in series, constituting a progressive starter and a drain-blocker, respectively, each unit comprising a distributor element mounted on a specific base plate.

FIG. 1 is a diagrammatic view of a modular system of distribution of a fluid under pressure, which comprises, in series, a flange B for connection to the system of supply of fluid under pressure, a unit $U_1$ constituting a progressive starter, a unit $U_2$ constituting a drain-blocker and a unit $U_3$ constituting a distributor proper or main distributor intended to supply with fluid under pressure a driving device such as for example a pneumatic motor or actuating cylinder, or a valve (not shown).

According to the invention, each unit comprises a distributor of the same type, for example of the basic type 5/2. Each distributor is mounted removably and interchangeably on the upper surface of a base plate which is designed to allow the unit to accomplish its specific function, i.e., that of a progressive starter, a drain-blocker and a distributor proper. The three base plates are associable between themselves.

In the progressive starter unit $U_1$, the base $E_1$ is configured so that the distributor $D_1$ functions as an element of the 2/2 type. The base $E_2$ has a structure allowing the distributor $D_2$ to fulfil the function of a 3/2 drain-blocker. As for the distributor $D_3$, hereinafter referred to as the main distributor in order to distinguish it from the other distributors, it functions in the 5/2 mode and is mounted on a base plate $E_3$. The structure of this plate is known.

Each distributor of the 5/2 type in the example illustrated comprises an orifice 1 for the supply of fluid under pressure, two utilization or outlet orifices 2, 4, two discharge orifices 3, 5 and two control orifices 12, 14 this type of distributor having two working positions and comprising a movable member, which can be switched between these two positions by way of a pressure which is applied to the two controlled orifices 12, 14, which receive for this purpose an outer control pressure fluid. The orifices are shown in FIG. 1 for the distributor $D_3$ which is used to fulfil the 5/2 function. The upper surface 20 of the base plate $E_3$ is configured as a mounting face and is provided with a series of seven orifices, each of which can be connected to an orifice of the distributor. The orifices of the mounting plane of the base are designated by the corresponding reference numerals 1', 2', 3', 4', 5', 12', and 14' (FIGS. 2, 3, 5, 6). Since the distributors $D_1$ and $D_2$ do not function in the 5/2 mode, but in the 2/2 and the 3/2 mode, respectively, the upper surfaces 20 configured as mounting faces display different orifice configurations as will be shown later.

As appears from the Figures, the three base plates $E_1$ to $E_3$ may be associated directly between themselves. To this end, the front connecting face 21 and the rear connecting face 22 of all the plates display the same configuration of three orifices. The front connecting face 21 is provided with an inlet orifice 23 for the supply of the unit considered with fluid under pressure and with two orifices 24 for connecting the unit to the discharge conduit. The rear connecting face 22 of each base plate comprises an outlet orifice 25 for the fluid under pressure and two orifices 26 for connection to the discharge conduit. The discharge orifices 24 and 26 in the front and rear connecting faces of each base plate are connected by two internal passages 27 provided in each base plate. In the base plate $E_3$, an internal passage 18 connects directly the inlet orifice 23 with the outlet orifice 25 for the fluid under pressure. On the other hand, as appears clearly from the Figures, the structure of the base plates $E_1$ and $E_3$ is different and depends on the functioning mode of the distributors $D_1$ and $D_2$. The structure of these base plates will be described hereafter.

Figure 2:
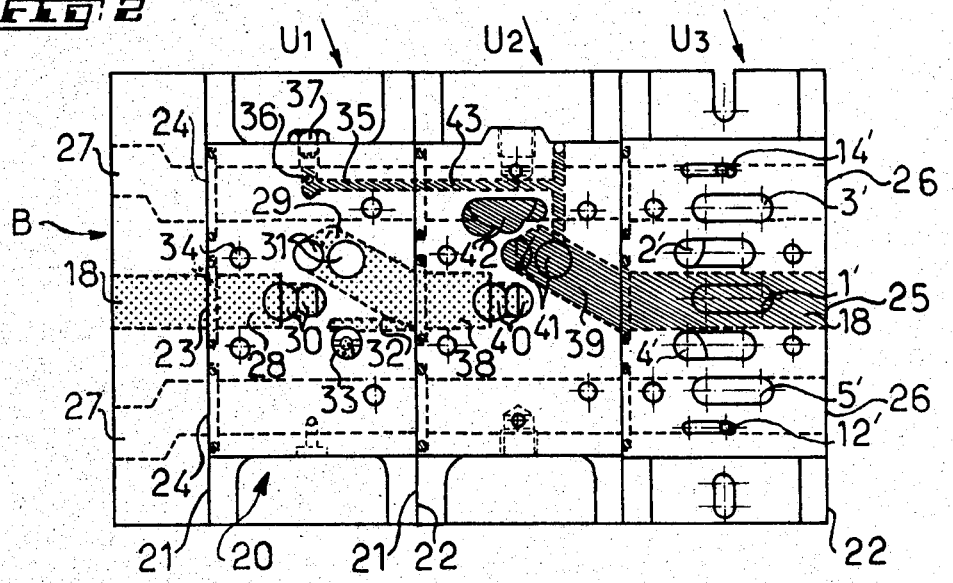
FIGS. 2 and 3 are top views showing the structure of the specific base plates and illustrating two operating conditions of the system according to FIG. 1.

It appears from FIGS. 1 and 2 that the pressure passage provided within the base plate $E_1$ is composed of two portions which do not communicate directly with one another, i.e., an inlet portion 28 and an outlet portion 29. The communication between these two portions is established by the distributor (FIG. 1). To this end, there is provided in the upper surface 20 of the base plate constituting the mounting face for the connection of the distributor $D_1$, an orifice 30 which communicates through a vertical passage with the inlet passage portion 28. Likewise, the mounting face 20 is provided with a set of orifices 31 which communicate through vertical passages with the outlet passage portion 29. The latter is connected by a passage of smaller diameter 32 with another vertical passage which opens onto the mounting face 20 through an orifice 33 which is calibrated by a removable nozzle or jet shown diagrammatically in the orifice 33. As observed when referring for example to FIG. 2, the orifices 30, 31 and 33 are arranged to correspond to the orifices 1', 2' and 4' so that they can be connected to the orifices 1, 2 and 4 of the distributor. It should be noted that the distributors $D_1$ and $D_2$ are turned through 180° with respect to the distributor $D_3$, as appears from the configurations of the hole 34 for the connection of the distributors to the base plates. In FIG. 2 there is also seen at 35 a conduit of smaller diameter which opens outwardly onto the rear connecting surface 22 and the upper mounting surface 20 through an orifice 36.

With the latter is also associated an external pipe union 37 which can be closed, as is the case in FIG. 1. The orifice 36 leads to a logic element L illustrated diagrammatically in FIG. 1. The element in integrated in the distributor in a manner known from U.S. Pat. No. 4,224,957, the disclosure of which is incorporated by reference herein. The element L is so connected as to compare the pressure in the orifice 36 with the pressure in the passage 28. When the pressure in the orifice reaches a predetermined threshold, the logic element L provides a switching signal to the distributor $D_1$. Another switching signal will be produced when the pressure in the orifice 36 subsequently falls below a predetermined threshold value.

Base plate $E_2$ of the unit $U_2$ intended to accomplish the function of a drain-blocker also comprises a pressure passage device which is made up of two portions, i.e., an inlet portion 38 and an outlet portion 39. The upper mounting surface 20 of this base is provided with orifices 40 and 41 communicating with the inlet and outlet portions 38 and 39, respectively, through appropriate vertical passages. The mounting face is also provided with an orifice 42 communicating with the discharge passage 27. The base plate $E_2$ also comprises an internal conduit 43 which opens at one end onto the front connecting surface 21 of the plate, at a location allowing it to be connected with the conduit 35 of the base plate $E_1$. At its other end, this conduit communicates with the outlet portion 39 of the pressure passage. It should be noted that the orifices 40, 41 and 42 correspond to the orifices 1', 4' and 5' of the base plate $E_3$ and are intended to be connected to the orifices 1, 4 and 5 of the distributor $D_2$.

A system of distribution represented diagrammatically in FIG. 1 and using the base plates whose structures appear in FIGS. 2 and 3 operates as follows.

FIGS. 1 and 2 show a system according to the invention in its initial state. The distributor $D_1$ of the progressive starter is in a position which ensures the communication between the pressure inlet orifice 30 and the calibrated orifice 33. The orifice 31 of the portion 29 of the pressure outlet passage is isolated from the orifice 30. The distributor $D_2$ of the drain-blocker is in a position in which it connects the discharge orifice 42 of the base plate $E_2$ with the orifice 41 and thus with the outlet passage 39 for the fluid under pressure. The inlet orifice 40 of the fluid under pressure is isolated. The distributor $D_2$ therefore is in the draining state. This means that the pressure passage 18 of the base plate $E_3$ is connected to the discharge system, as illustrated by the hatched region of FIG. 2.

When fluid under pressure is applied to the inlet of the system of distribution according to the invention, the pressure builds up only progressively in the outlet pressure passage 29 of the base plate $E_1$, owing to the calibrated orifice 33 which communicates with the orifice 30 through the distributor $D_1$. So long as the drain-blocker is in the draining state, this pressure is blocked at the orifice 40 of the base plate $E_2$. If an operator switches at the same time the distributor $D_2$ of the drain-blocker and thus creates the conditions illustrated in FIG. 3, wherein the orifice 41 of the base plate $E_2$ is isolated from the discharge orifice 42 and communicates with the orifice 40 through the distributor $D_2$, the pressure prevailing in the inlet pressure passage 30 may build up in the outlet pressure passage 39 and in the pressure passage 18 of the base plate $E_3$. This pressure is also transmitted, through the conduits 43 and 35 and the orifice 36 of the base plate $E_1$ to the logic element L. As soon as the pressure in the passage 18 of the base plate $E_3$, which increases progressively owing to the calibrated orifice 33 and its nozzle or jet, reaches a predetermined threshold corresponding for example to 60% of the pressure applied at the entry of the system, this element, which moreover receives through an internal conduit 44 the fluid under pressure (FIG. 1), produces a signal permitting or causing the switching of the distributor $D_1$ of the progressive starter. After its switching, the distributor connects the orficies 30 and 31 and isolates the calibrated orifice 33. The pressure at the inlet of the system will therefore immediately build up in the pressure passage 18 of the base plate $E_3$. There are thus obtained the operating conditions shown in FIG. 2 by the dotted regions.

In this situation, the distributor $D_3$ is in a condition to supply a driving device (not shown) with fluid under pressure, through the medium of its base plate.

If the drain-blocker distributor $D_2$ is re-switched to its draining position illustrated in FIG. 2, the orifice 41 is again connected to the discharge passage 27 through the medium of the orifice 42 of the base plate $E_2$. Since the orifice 41 of the base $E_2$ and the orifice 36 of the base $E_1$ are connected to one another through the conduits 43 and 35, the pressure at the logic element L also falls to reach the value of one atmosphere. When this pressure drop reaches about 50% of the pressure applied at the entry of the system, the logic element will produce an appropriate impulse which restores the distributor to its initial position in which the orifices 31 of the base plate $E_1$ are isolated from the inlet pressure orifices 30, as illustrated by the white regions within the circles representing the orifices 31. The progressive starter is thus ready to accomplish its function upon a further switching of the drain-blocker.

It should be borne in mind that the progressive starter operates automatically depending on the state of the drain-blocker. Systematically after each draining of the system according to the invention, the progressive starter automatically reassumes its small flow-rate position defined by the communication between the inlet orifice 30 and the calibrated orifice 33 of the base plate $E_1$.

It should be noted that the orifice 33 is calibrated by a nozzle or jet which is screwed into the base. This allows the user to choose the calibration diameter depending on the quantity of actuating cylinders or more generally of driving devices to be controlled.

Although the system just described comprises a progressive starter and a drain-blocker, these auxiliary units may be used separately.

Figure 3:
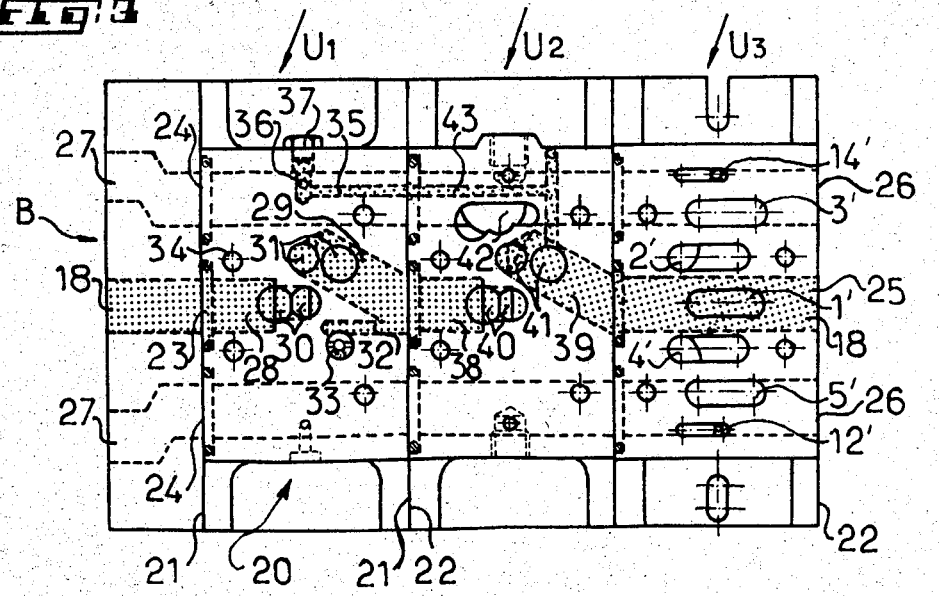
Figure 4:
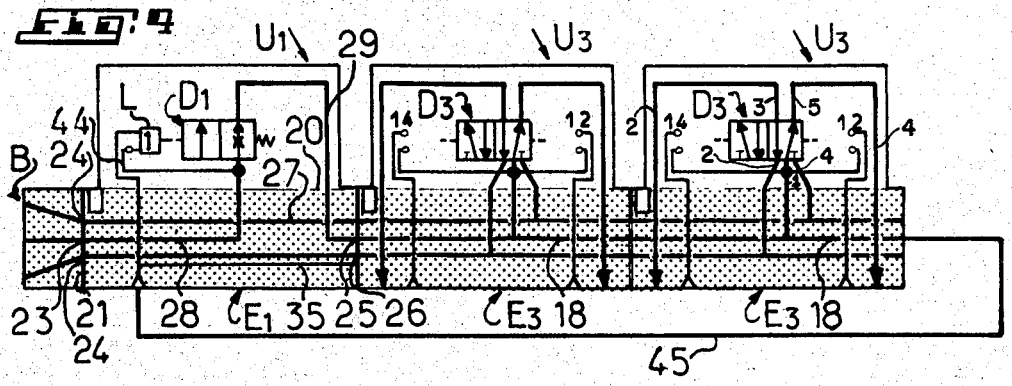
FIG. 4 is a diagrammatic view of a system of distribution according to the invention, comprising an auxiliary unit constituting a progressive starter mounted upstream of a block of two distributors.
Figure 5:
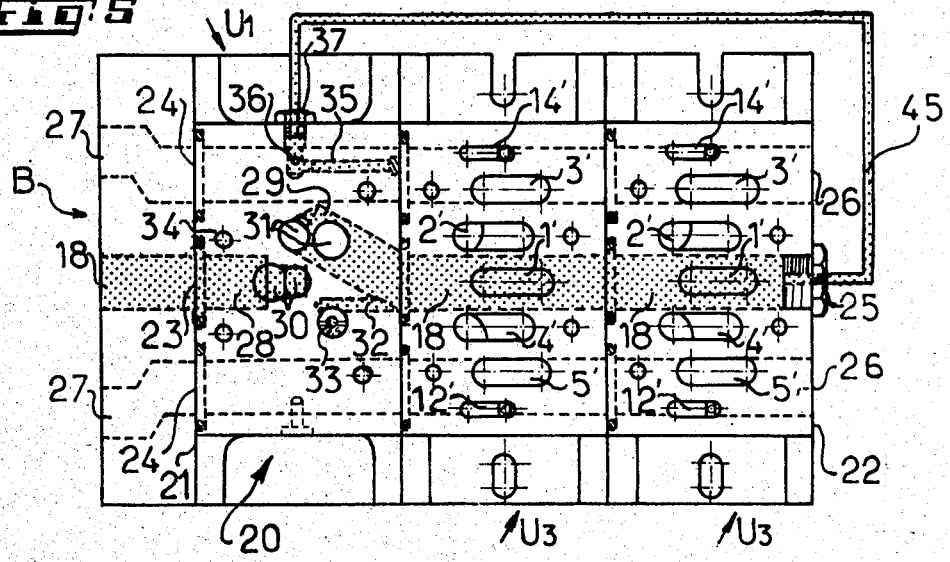
FIG. 5 illustrates the structure of the base plates of the system according to FIG. 4 and the operation of the latter.

Thus, FIGS. 4 and 5 show a modular system of distribution of a fluid under pressure, according to the invention, in which a unit $U_1$ arranged according to FIGS. 1 to 3 to constitute a progressive starter is mounted directly upstream of a block of two distributing units $U_3$, $U_3'$. The elimination of the drain-blocker does not in any way modify the level of the progressive starter, apart from the fact that the orifice 36 leading to the logic element L now receives the pressure which builds up progressively in the outlet pressure passage 29 of the base $E_1$ and consequently in the pressure passages 18 of the base plates $E_3$, $E_3'$ through an external conduit 45 connecting the outlet of the pressure passage 18 of the last base plate $E_3'$ to the external pipe union 37 of the base plate $E_1$ of the progressive starter. As appears from FIG. 5, the internal conduit 35 of the base plate $E_1$ is closed at the rear connecting surface 22 of this base plate. The operation of the progressive starter shown in FIGS. 4 and 5 is identical with the one just described with reference to FIGS. 1 to 3.

Figure 6:
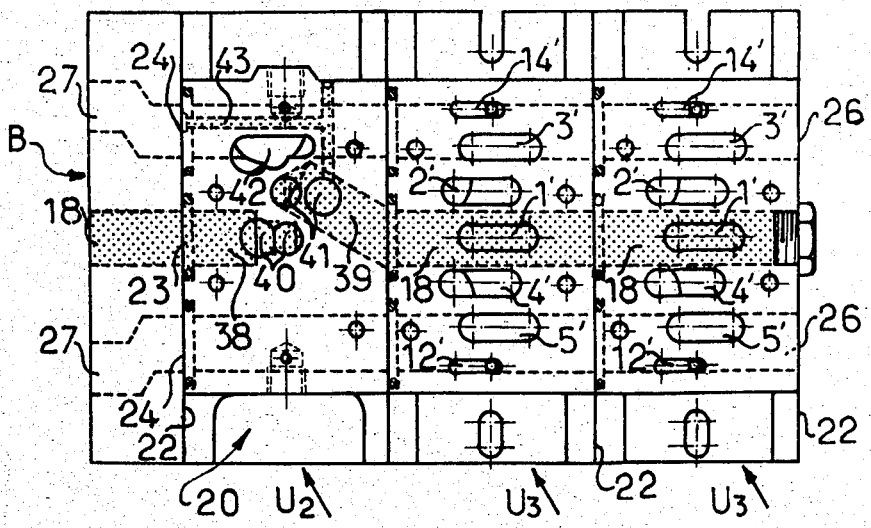
FIG. 6 is a top view showing the structure of the base of a system of distribution according to the invention, comprising a drain-blocker unit mounted upstream of a block of two distributors.

FIG. 6 shows a system in which a unit $U_2$ constituting a drain-blocker according to FIGS. 1 to 3 is mounted at the head of a block of distributors $U_3$, $U_3'$, without progressive starter. As can be seen in comparing these Figures and FIG. 6, there is no difference between the two cases from the point of view of both the structure and the operation, except for the fact that the internal conduit 43 is now closed at its outwardly opening ends.

After the above description of the structure of the auxiliary unit and of the systems in which the latter are incorporated, the advantage gained from the present invention is readily understood. Indeed, the latter allows the use in all the units of the same type of distributor and it is only the base plates, which can be manufactured easily and at relatively low cost, that are different and configured to allow the distributor to fulfil a specific function, such as for example the function of a progressive starter or of a drain-blocker, as in the systems which have just been described by way of non limitative example.

What is claimed is:

1. A modular system for the distribution of a pressure fluid connected to a pressure fluid supply system and to a driving device adapted to receive said fluid, said modular system comprising:

at least one main unit ($U_3$) comprising a distributor ($D_3$) and a base plate ($E_3$) provided with a mounting face, said base plate ensuring the connection of said distributor to said driving device and to said fluid supply system, said distributor being mounted interchangeably by means of a mounting face on said mounting face of said base plate, said distributor mounting face and said base plate mounting face comprising the same configuration of registering orifices of supply connectable to said fluid system, of outlet for the distribution of the pressure fluid to said driving device, of discharge and of control, said distributor being switchable between two positions for establishing predetermined connections between said distributor mounting face supply and outlet orifices, said base plate ($E_3$) comprising a front and a rear connecting face provided respectively with the same configuration of two discharge orifices and one pressure fluid orifice which is an inlet orifice in the front face and an outlet orifice in the rear face, said base plate ($E_3$) having external orifices connectable to said driving device and additionally comprising internal passageways connecting said pressure fluid inlet orifice of said front connecting face to said pressure fluid outlet orifice of said rear connecting face and to said pressure fluid supply orifice of said base plate mounting face, for connecting each one of the two discharge orifices of said front connecting face to one corresponding discharge orifice of said rear connecting face and to one corresponding discharge orifice of said base plate mounting face and for connecting each one of said outlet orifices of said base plate mounting face to said external orifices connectable to said driving device;

at least one auxiliary unit ($U_1$) mounted upstream in series with said main unit ($U_3$) to constitute a progressive starter, said auxiliary unit ($U_1$) comprising a distributor ($D_1$) and a base plate ($E_1$) provided with a mounting face, said distributor ($D_1$) being mounted interchangeably by means of a mounting face on said mounting face of said auxiliary unit base plate, said auxiliary unit base plate ($E_1$) comprising front and rear connecting faces provided for the connection of said auxiliary unit ($U_1$) to said main unit ($U_3$) and to said fluid supply system, said front and rear connecting faces of said auxiliary unit base plate having the same configuration of two discharge orifices and one pressure orifice which is a pressure inlet orifice in the front face and an outlet pressure orifice in the rear face, each one of said front connecting face discharge orifices being directly connected through internal passageway to a corresponding rear connecting face discharge orifice, wherein the improvement consists in that said auxiliary unit distributor ($D_1$) is of the same type as the main unit distributor ($D_3$), whereas the auxiliary unit base plate differs from the one of the main unit, and in that said auxiliary unit base plate mounting face comprises a first pressure fluid orifice communicating with said pressure inlet orifice of said front connecting face of said auxiliary unit base plate ($E_1$), a second orifice and a third calibrated orifice provided with a nozzle, these two orifices communicating with the outlet pressure orifice of the rear connecting face of said auxiliary unit base plate, each of said auxiliary unit base plate mounting face orifices being in a registering relationship with an auxiliary unit distributor mounting face orifice, and said two orifices are alternately connectable through communication of said auxiliary distributor to said pressure fluid orifice of said auxiliary unit base plate mounting face, the auxiliary unit distributor mounting face orifices without registering auxiliary unit base plate mounting face orifice being obturated by said auxiliary unit base plate mounting face, said three orifices of said auxiliary unit base plate mounting face being so arranged that the auxiliary unit distributor ($D_1$) connects the first orifice either to the second orifice or to the third, calibrated orifice, depending on its switching position.

2. A system according to claim 1, wherein said auxiliary unit ($U_1$) constitutes a progressive starting distributor ($D_1$) of the five ways-two positions type, the auxiliary base plate ($E_1$) being so configured that the auxiliary unit distributor ($D_1$) fulfills a two ways-two position function.

3. A system according to claim 1, wherein said second and third orifices of the mounting face of said auxiliary unit base plate are located opposite the orifices of said auxiliary unit distributor mounting face, which are connectable to the driving device by means of the auxiliary base plate.

4. A system according to claim 1, wherein the mounting face of said auxiliary unit base plate ($E_1$) comprises a fourth orifice arranged opposite to a control orifice of the auxiliary unit distributor mounting face, and communicating with an external pipe union and with an internal conduit of said auxiliary unit base plate, opening on to the rear connecting face of said base plate, which orifice can be used for automatic switching of the auxiliary unit distributor ($D_1$).

5. A system according to claim 4, wherein said system comprises a second auxiliary unit ($U_2$) mounted upstream in series between said first auxiliary unit ($U_1$) and said main unit ($U_3$), said second auxiliary unit ($U_2$) comprising a distributor ($D_2$) and a base plate ($E_2$) provided with a mounting face, said second auxiliary unit distributor being mounted interchangeably by means of a mounting face on said mounting face of said auxiliary unit base plate ($E_2$), said second auxiliary unit base plate ($E_2$) comprising front and rear connecting faces provided for connecting said second auxiliary unit ($U_2$) respectively to said main unit ($U_3$) and to said first auxiliary unit ($U_1$), said front and rear connecting faces having the same configuration of two discharge orifices and one pressure orifice, which is a pressure inlet orifice in the front face and an outlet pressure orifice in the rear face, each one of said front connecting face discharge orifices being directly connected through an internal discharge passageway to one corresponding rear connecting face discharge orifice, wherein the improvement consists in that said second auxiliary unit distributor ($D_2$) is of the same type as the main unit distributor ($D_3$), whereas the auxiliary unit base plate ($E_2$) differs from the one of the main unit, and in that said second auxiliary unit base plate mounting face comprises a first orifice connected through an internal pressure inlet passage to said pressure inlet orifice of said front connecting face of said second auxiliary unit base plate, a second orifice connected through an outlet pressure passage to said outlet pressure orifice of said rear connecting face of said second auxiliary unit base plate, and a third orifice communicating with one of said internal discharge passageways of said auxiliary unit base plate ($E_2$), each of said second auxiliary unit base plate mounting face orifices being in a registering relationship with a second auxiliary unit distributor mounting face orifice, the second auxiliary unit distributor mounting face orifices without registering auxiliary unit base plate mounting face orifice being obturated by said second auxiliary unit base plate mounting face, said orifices of said second auxiliary unit base plate mounting face being so arranged that said second auxiliary unit distributor ($D_2$) connects said second orifice either to said first orifice or to said third orifice, depending on its switching position.

6. A system according to claim 5, wherein the second auxiliary unit base plate ($E_2$) comprises an internal conduit providing communication between the outlet pressure passage and an orifice in the front connecting face of said second auxiliary unit base plate ($E_2$), the outlet orifice of the conduit being arranged so that it can communicate with the outlet orifice of the conduit of the first auxiliary unit base plate ($E_1$), when the two auxiliary unit base plate ($E_1$, $E_2$) are associated with one another.

7. A system according to claim 6, wherein the external pipe union of the base plate ($E_1$) of the progressive starter unit ($U_1$) is closed and the conduit of the base plate ($E_1$,$E_2$) communicate with one another.

8. A system according to claim 7, wherein the connections between the orifices of the mounting face of said auxiliary unit base plate ($E_1$,$E_2$) with the orifices in the front and rear connecting faces of said base plate are ensured by internal passages of the latter.

9. A system according to claim 4, wherein the fourth orifice is connected to an inlet of a two-inlet logic element (L) which is mounted on the auxiliary unit distributor ($D_1$) and receives at its other inlet constituting a reference inlet the entire pressure of the pressure fluid, the logic element (L) producing a switching signal when the pressure at the fourth orifice reaches a predetermined threshold with respect to the pressure at its reference inlet.

10. A modular system for the distribution of a pressure fluid connected to a pressure fluid supply system and to a driving device adapted to receive said fluid, said modular system comprising:

at least one main unit ($U_3$) comprising a distributor ($D_3$) and a base plate ($E_3$) provided with a mounting face, said base plate ensuring the connection of said distributor to said driving device and to said fluid supply sysgtem, said distributor being mounted interchangeably by means of a mounting face on said mounting face of said base plate, said distributor mounting face and said base plate mounting face comprising the same configuration of registering orifices of supply connectable to said fluid supply system, of outlet for the distribution of the pressure fluid to said driving device, of discharge and of control, said distributor being switchable between two positions for establishing predetermined connections between said distributor mounting face supply and outlet orifices, said base plate ($E_3$) comprising a front and a rear connecting face provided respectively with the same configuration of two discharge orifices and one pressure fluid orifice which is an inlet orifice in the front face and an outlet orifice in the rear face, said base plate ($E_3$) having external orifices connectable to said driving device and additionally comprising internal passageways connecting said pressure fluid inlet orifice of said front connecting face to said pressure fluid outlet orifice of said rear connecting face and to said pressure fluid supply orifice of said base plate mounting face, for connecting each one of the two discharge orifices of said front connecting face to one corresponding discharge orifice of said rear connecting face and to one corresponding dischage orifice of said base plate mounting face and for connecting each one of said outlet orifices of said base plate mounting face to said external orifices connectable to said driving device;

at least one auxiliary unit ($U_2$) mounted upstream in series with said main unit ($U_3$) to constitute a drain-blocker, said auxiliary unit ($U_2$) comprising a distributor ($D_2$) and a base plate ($E_2$) provided with a mounting face, said distributor ($D_2$) being mounted interchangeably by means of a mounting face on said mounting face of said auxiliary unit base plate ($E_2$), said auxiliary unit base plate ($E_2$) comprising front and rear connecting faces provided for the connection of said auxiliary unit ($U_2$) to said main unit ($U_3$) and to said fluid supply system, said front and rear connecting faces of said auxiliary unit base plate having the same configuration of two discharge orifices and one pressure orifice, which is a pressure inlet orifice in the front face, and an outlet pressure orifice in the rear face, each one of said front connecting face discharge orifices being directly connected through an internal passageway to one corresponding rear connecting face discharge orifice, wherein the improvement consists in that said auxiliary unit distributor ($D_2$) is of the same type as the main unit distributor ($D_3$), whereas the auxiliary unit base plate ($E_2$) differs from the one of the main unit, and in that said auxiliary unit base plate mounting face comprises a first orifice connected through an internal pressure fluid inlet passage to the pressure fluid orifice in the front connecting face of said auxiliary unit base plate ($E_2$), a second orifice connected through an outlet pressure fluid pressure to the outlet pressure fluid orifice in the rear connecting face of said auxiliary unit base plate ($E_2$) and a third orifice communicating with one of said internal discharge passageways of said auxiliary unit base plate ($E_2$), each of said auxiliary unit base plate mounting face orifices being in a registering relationship with an auxiliary unit distributor mounting face orifice, the auxiliary unit distributor mounting face orifices without registering auxiliary unit base plate mounting face orifice being obturated by said auxiliary unit base plate mounting face, said three orifices of said auxiliary unit base plate mounting face being so arranged that the auxiliary unit distributor ($D_2$) connects said second orifice either to said first orifice of said third orifice, depending on its switching position.

11. A system according to claim 10, wherein, in an auxiliary unit constituting a drain-blocker and using a distributor ($D_2$) of the five ways-two positions type, the base plate ($E_2$) is so configured that the distributor ($D_2$) fulfills a three ways-two positions function.

* * * * *